US007535452B2

(12) United States Patent
Kang et al.

(10) Patent No.: US 7,535,452 B2
(45) Date of Patent: May 19, 2009

(54) TIMING CONTROLLER AND METHOD FOR REDUCING LIQUID CRYSTAL DISPLAY OPERATING CURRENT

(75) Inventors: Won-Sik Kang, Seoul (KR); Jae-Goo Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 902 days.

(21) Appl. No.: 10/981,056

(22) Filed: Nov. 4, 2004

(65) Prior Publication Data

US 2005/0093808 A1 May 5, 2005

(30) Foreign Application Priority Data

Nov. 5, 2003 (KR) ..... 10-2003-0078108

(51) Int. Cl.
*G09G 3/36* (2006.01)

(52) U.S. Cl. ..... 345/99; 345/98

(58) Field of Classification Search ..... 345/213, 345/87–100

See application file for complete search history.

(56) References Cited

U.S. PATENT DOCUMENTS

| | | | | |
|---|---|---|---|---|
| 5,600,580 | A * | 2/1997 | Honjo et al. | 361/681 |
| 5,742,261 | A * | 4/1998 | Yuki et al. | 345/3.3 |
| 5,793,363 | A * | 8/1998 | Takuwa | 345/98 |
| 6,445,372 | B1 * | 9/2002 | Asai | 345/99 |
| 7,084,861 | B2 * | 8/2006 | Iisaka | 345/89 |
| 7,123,229 | B2 * | 10/2006 | Toyozawa et al. | 345/98 |
| 2001/0013849 | A1 * | 8/2001 | Furukoshi | 345/87 |
| 2002/0044127 | A1 * | 4/2002 | Uchino et al. | 345/98 |
| 2002/0118157 | A1 * | 8/2002 | Lee et al. | 345/87 |
| 2004/0041776 | A1 * | 3/2004 | Yokokawa | 345/99 |

FOREIGN PATENT DOCUMENTS

| | | |
|---|---|---|
| CN | 1371088 | 9/2002 |
| JP | 10228012 | 8/1998 |
| JP | 2000284756 | 5/2004 |
| KR | 1997024406 | 7/1997 |
| KR | 1998082413 | 12/1998 |
| KR | 1999022629 | 3/1999 |

OTHER PUBLICATIONS

Second Office Action dated Aug. 8, 2008 in corresponding Chinese Application 2004100997685.

* cited by examiner

*Primary Examiner*—Amr Awad
*Assistant Examiner*—Waseem Moorad
(74) *Attorney, Agent, or Firm*—F. Chau & Associates, LLC

(57) ABSTRACT

Provided are a timing controller, a liquid crystal display (LCD) driver including the same, and a method of outputting display data, where the timing controller receives a vertical synchronous signal and a data enable signal, generates an internal data enable signal having a period that is longer than the period of the data enable signal in response to the vertical synchronous signal and the data enable signal, and updates a memory using the internal data enable signal; where the LCD driver including the timing controller outputs display data stored in a memory device based on the internal data enable signal; where a data line driving circuit drives data lines based on the output display data; and where the method of outputting display data is performed by the LCD driver.

19 Claims, 4 Drawing Sheets

TIMING CONTROLLER AND METHOD FOR REDUCING LIQUID CRYSTAL DISPLAY OPERATING CURRENT

CROSS-REFERENCE TO RELATED APPLICATION

This application claims foreign priority under 35 U.S.C. § 119 to Korean Patent Application No. 2003-78108, filed on Nov. 5, 2003, in the Korean Intellectual Property Office, the disclosure of which is incorporated herein by reference in its entirety.

BACKGROUND OF THE INVENTION

1. Field of the Invention

The present disclosure relates to liquid crystal display (LCD) drivers, and more particularly, to a method and apparatus for effectively controlling a memory update using a video interface, thereby reducing the power consumed by an LCD.

2. Description of the Related Art

Generally, liquid crystal display panels used in electronic devices, such as mobile phones and Personal Data Assistants (PDAs), are classified into passive matrix type liquid crystal display panels, and active matrix type liquid crystal display panels that include switching devices such as thin film transistors (TFT).

The passive matrix type liquid crystal panels consume less power than the active matrix type liquid crystal panels. In other words, the passive matrix type liquid crystal panels have an advantage of being able to reduce power consumption more than the active matrix type liquid crystal panels.

However, multiple colors and moving images are not easily displayed on the passive matrix type liquid crystal panels. On the other hand, the active matrix type liquid crystal panels are suitable for displaying multiple colors and moving images.

There is a large demand for liquid display panels displaying multiple colors and moving images with high quality for portable electronic devices such as mobile phones and PDAs. Consumers also prefer to use the portable electronic devices for a long time after being charged. Therefore, the issue of displaying multiple colors and moving images with high quality while reducing power consumption must be considered.

SUMMARY OF THE INVENTION

The present disclosure provides a method and apparatus for reducing power consumption of a liquid crystal display (LCD).

According to an aspect of the present disclosure, there is provided a timing controller of a liquid crystal display driver controlling the timing of each of a scan line driving circuit and a data line driving circuit. The timing controller includes an n-bit counter counting a number of pulses of a vertical synchronous signal clocked at the vertical synchronous signal and generating an n-bit count signal; a determination circuit receiving the n-bit count signal, comparing the n-bit count signal with a predetermined n-bit reference signal, and outputting the result of comparison; a first NAND gate NANDing a signal output from the determination circuit and a data enable signal; a second NAND gate NANDing a signal output from the first NAND gate and a clock signal; and a memory device receiving and storing first display data in response to the signal output from the second NAND gate. The timing controller further includes a third NAND gate NANDing the signal output from the first NAND gate and second display data and outputting the first display data.

According to another aspect of the present disclosure, there is provided a liquid crystal display driver (LCD) driving a liquid crystal display panel including data lines and scan lines. The LCD driver includes a timing controller including a memory device, a data line driving circuit driving data lines of the liquid crystal display panel based on display data stored in the memory device, and a scan line driving circuit sequentially driving the scan lines. The timing controller controls the timing of each of the data line driving circuit and the scan line driving circuit in response to control signals including a vertical synchronous signal and a data enable signal and generates an internal data enable signal in response to the control signals. The memory device receives and stores the input display data in response to the internal data enable signal having a period that is an integral multiple of the period of the data enable signal. The memory device receives and stores the input display data only when the internal data enable signal is activated.

The timing controller includes an n-bit counter counting a number of pulses of the vertical synchronous signal by being clocked at the vertical synchronous signal and generating an n-bit count signal; a determination circuit receiving the n-bit count signal, comparing the n-bit counting signal with a predetermined n-bit reference signal, and outputting the result of comparison; a first NAND gate NANDing a signal output from the determination circuit and the data enable signal; a second NAND gate NANDing a signal output from the first NAND gate and the clock signal; and a third NAND gate NANDing the signal output from the first NAND gate and the input display data, and the memory device receives and stores first display data in response to the signal output from the first NAND gate.

According to another aspect of the present disclosure, there is provided a liquid crystal display driver driving a liquid crystal display panel including data lines and scan lines. The liquid crystal display driver includes a timing controller including a memory device, a data line driving circuit driving data lines of the liquid crystal display panel based on display data stored in the memory device, and a scan line driving circuit sequentially driving the scan lines. The timing controller controls the timing of each of the data line driving circuit and the scan line driving circuit in response to control signals including a vertical synchronous signal and a data enable signal and generates an internal data enable signal in response to the control signals. The memory device receives and stores the input display data in response to the internal data enable signal having a period that is longer than the period of the data enable signal.

According to another aspect of the present disclosure, there is provided a method of outputting display data stored in a memory device to a data line driving circuit driving data lines of a liquid crystal display panel including the data lines and scan lines. The method includes generating an internal data enable signal having a period that is an integral multiple of the period of a data enable signal in response to a vertical synchronous signal and a data enable signal; receiving and storing display data in response to the internal data enable signal; and transmitting display data stored in the memory device to the data line driving circuit in response to control signals.

The generating the internal data enable signal includes counting a number of pulses of the vertical synchronous signal and outputting the result; comparing the result with a reference value and outputting the result of comparison; and generating the internal data enable signal based on the result of comparison and the data enable signal.

The receiving and storing the display data includes logically combining the internal data enable signal and the clock signal and generating a data write enable signal; generating the display data by logically combining the internal data enable signal and input display data; and receiving and storing display data output from the memory device in response to the data write enable signal.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION OF PREFERRED EMBODIMENTS

Figure 1:
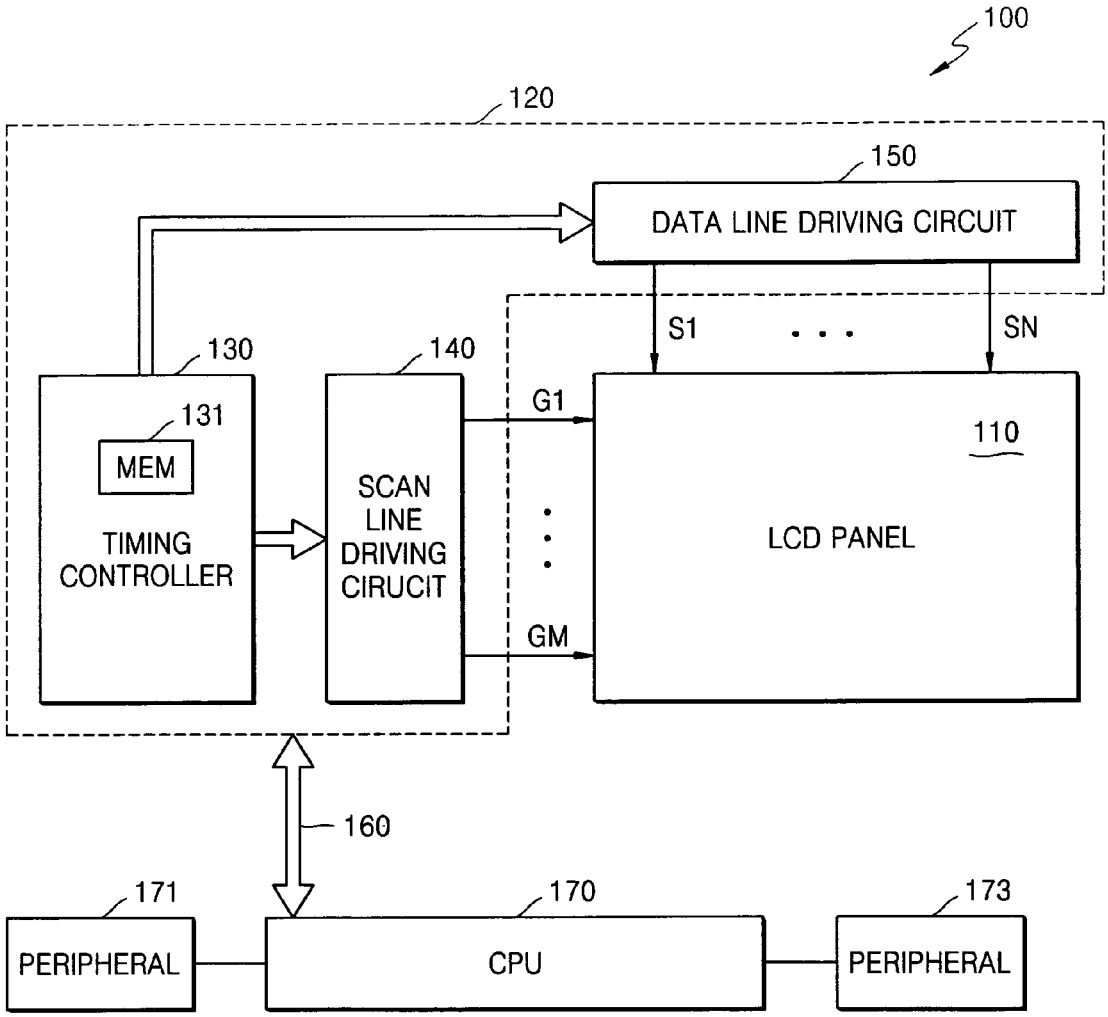
FIG. 1 (PRIOR ART)
FIG. 1 is a block diagram of a conventional liquid crystal display (LCD) including a CPU interface.

The attached drawings for illustrating embodiments of the present disclosure are referred to in order to gain a sufficient understanding of the present disclosure, the merits thereof, and the advantages realized by implementation of exemplary embodiments of the present disclosure.

Hereinafter, the present disclosure will be described in detail by explaining embodiments of the disclosure with reference to the attached drawings. Like reference numerals in the drawings may be used to denote like elements.

As shown in FIG. 1, a conventional liquid crystal display (LCD) is indicated generally by the reference numeral 100. The LCD 100 includes a central processing unit (CPU) interface 160. The LCD 100 further includes an LCD panel 110, an LCD driver 120, a CPU 170, and a plurality of peripherals 171 and 173. The peripheral 171 may be a camera module of a mobile phone, and the peripheral 173 may be a memory device for storing a large volume of data.

The LCD driver 120 includes a scan line driving circuit 140, which is often called a gate driver block, and a data line driving circuit 150, which is often called a source driver block. The timing controller 130 includes a graphics random access memory (RAM) 131 and generates control signals for controlling the timing of each of the scan line driving circuit 140 and the data line driving circuit 150.

The graphics RAM 131 stores display data equivalent to at least 60 frames and transmits the display data (or image data) to the data line driving circuit 150. The scan line driving circuit 140 includes a plurality of gate drivers (not shown) and sequentially drives first through $m^{th}$ scan lines G1 through GM of the LCD panel 110 in response to the control signals output from the timing controller 130.

The data line driving circuit 150 includes a plurality of source drivers (not shown) and sequentially drives first through $n^{th}$ data lines S1 through SN of the LCD panel 110 based on the display data output from the graphic RAM 131 and the control signals output from the timing controller 130.

The LCD panel 110 displays display data output from the CPU 170 in response to signals generated by the scan line driving circuit 140 and the data line driving circuit 150.

The timing controller 130 of the LCD driver 120 receives a plurality of display data and control signals output from the CPU 170 via the CPU interface 160, and updates the display data stored in the graphics RAM 131.

Even when a still image is displayed on the LCD panel 110, the CPU 170 transmits tens of frames of display data per second to the timing controller 130. Then, the timing controller 130 transmits the display data to the graphic RAM 131, and the graphic RAM 131 continuously updates tens of frames of display data per second. This is a memory update operation, and an electric current consumed when updating a memory is called an operating current for memory update.

In other words, power consumption of portable electronic devices increases when updating the display data. In addition, the access load of the CPU 170 increases when directly communicating with the LCD driver 120. Therefore, the CPU 170 fails to fully support diverse graphics and moving images input from each of the peripherals 171 and 173.

Further, the size and manufacturing costs of the CPU 170 increase. When a frequency of a system clock used by the CPU 170 and that of a clock used by the graphic RAM 131 are not the same, moving images displayed on the LCD panel 110 exhibit a tearing phenomenon, thereby deteriorating the quality of moving or still images displayed on the LCD panel 110.

Figure 2:
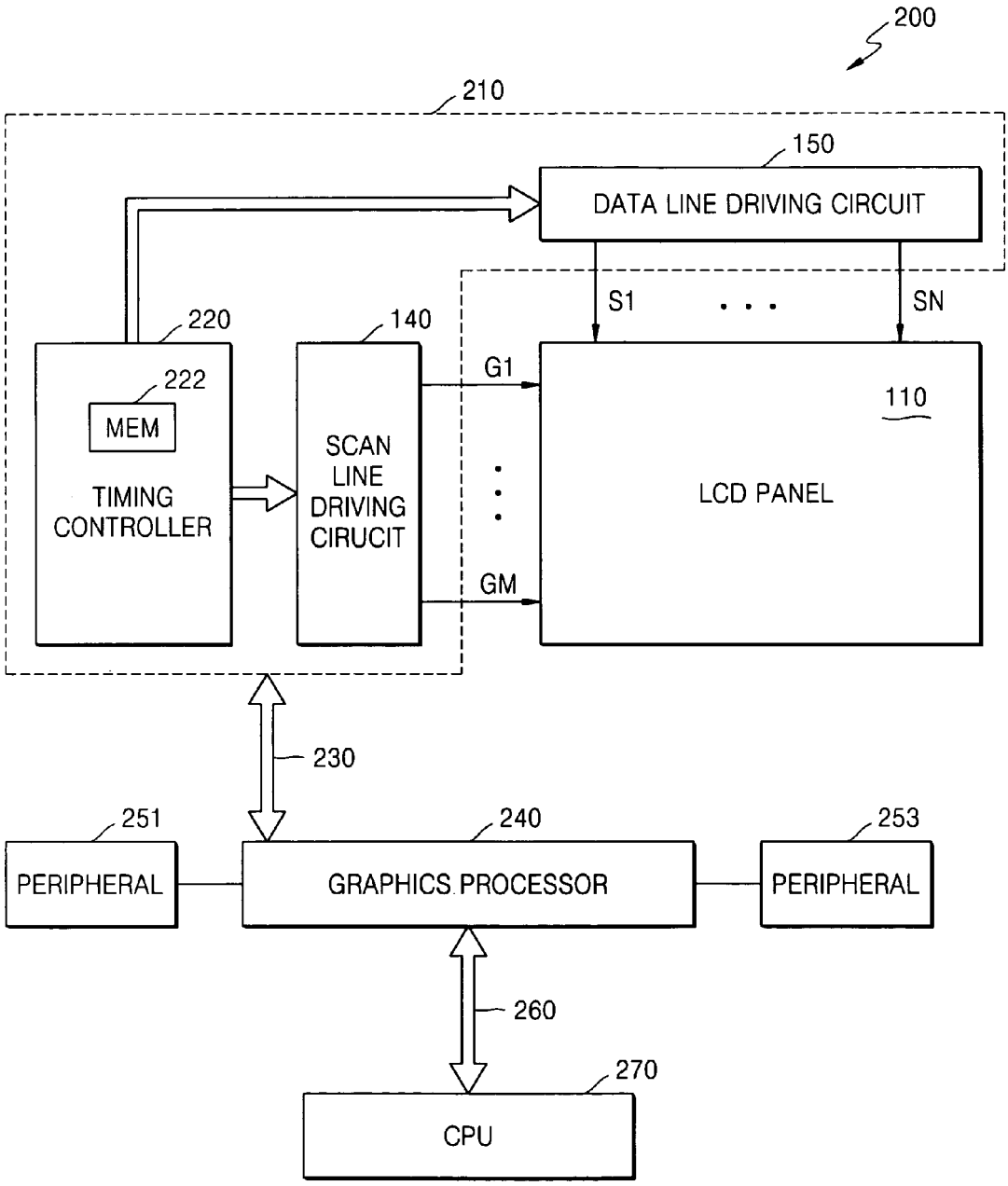
FIG. 2 is a block diagram of an LCD including a timing controller according to an embodiment of the present disclosure.

Turning to FIG. 2, an LCD according to an embodiment of the present disclosure is indicated generally by the reference numeral 200. The LCD 200 includes a timing controller 220. The LCD 200 further includes a graphics processor 240 and a video interface 230 that reduce the access load of a CPU 270, support a variety of graphics and moving images, and prevent deterioration of the quality of moving images displayed due to a tearing phenomenon.

The LCD 200 includes an LCD panel 110, an LCD driver 210, a graphics processor 240 or a graphics processing chip set, the CPU 270, a video interface 230, a CPU interface 260, and a plurality of peripherals 251 and 253.

The LCD driver 210 and the graphics processor 240 exchange predetermined data via the video interface 230. The graphics processor 240 and the CPU 270 exchange predetermined data via the CPU interface 260.

The LCD driver 210 includes a timing controller 220 including a memory device 222, a scan line driving circuit 140, and a data line driving circuit 150. The memory device 222 may be a graphics RAM.

The timing controller 220 generates an internal data enable signal in response to control signals generated by the graphics processor 240 and received via the video interface 230.

The data line driving circuit 150 receives display data from the memory device 222 in response to the control signals of the timing controller 220 and transmits the display data to the LCD panel 110.

The graphics processor 240 receives and processes graphic and image data output from the CPU 270 and the peripherals 251 and 253.

Figure 3:
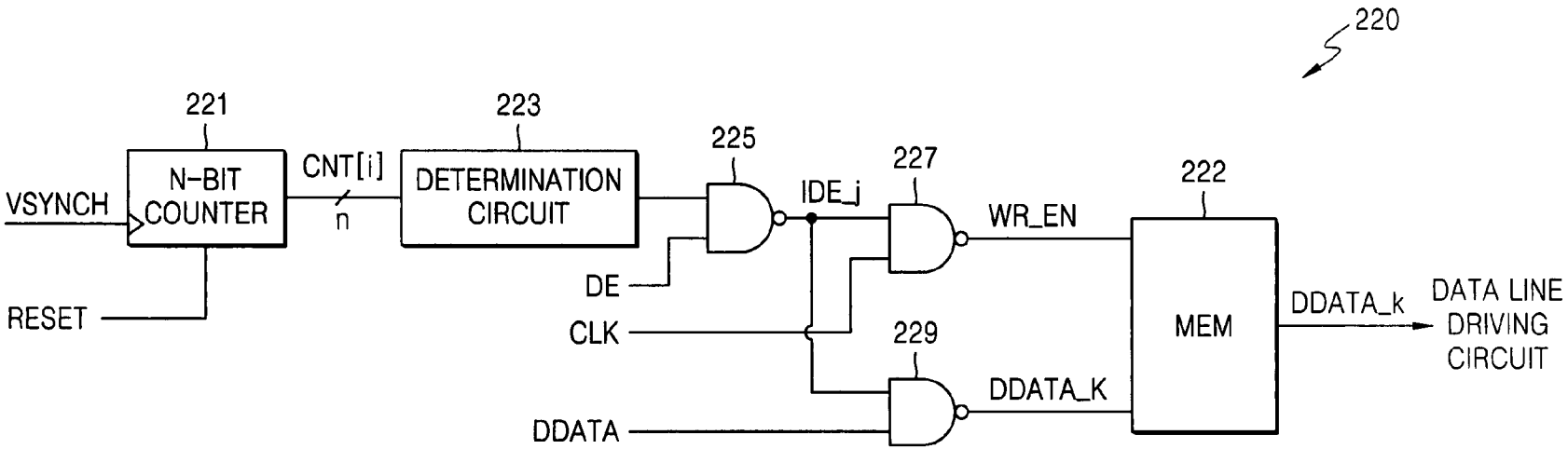
FIG. 3 is a block diagram of a timing controller according to an embodiment of the present disclosure.

Turning now to FIG. 3, a timing controller according to an embodiment of the present disclosure is indicated generally by the reference numeral 220. The timing controller 220 includes an n-bit counter 221, a determination circuit 223, a first NAND gate 225, a second NAND gate 227, a third NAND gate 229, and the memory device 222.

A vertical synchronous signal VSYNCH, a data enable signal DE, a clock signal CLK, and display data DDATA generated by the graphics processor 240 are input to the timing controller 220 via the video interface 230.

Figure 4:
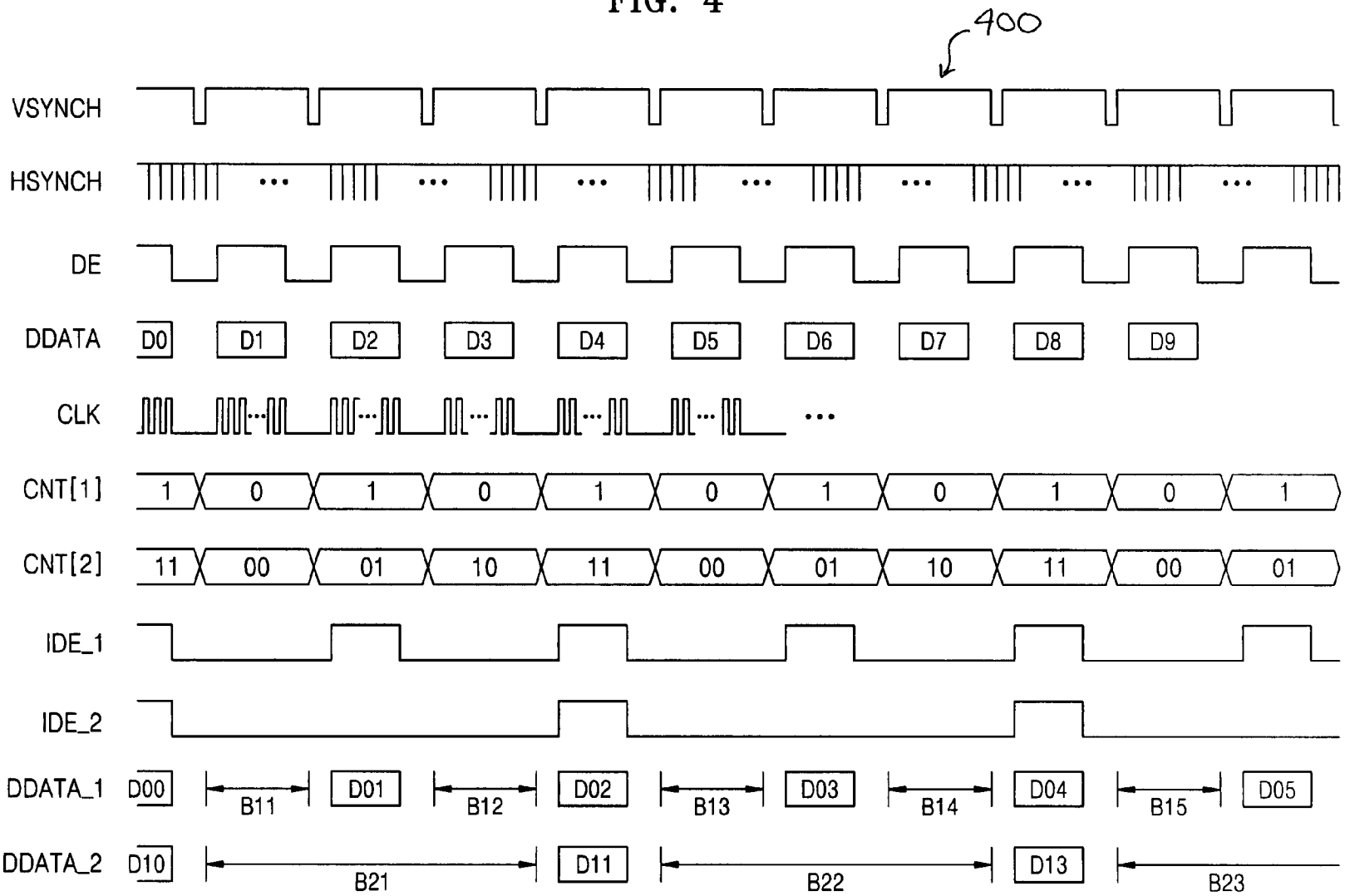
FIG. 4 is a timing diagram illustrating the operation of the timing controller of FIG. 3.

As shown in FIG. 4, a timing diagram illustrating the operation of the timing controller 220 of FIG. 3 is indicated generally by the reference numeral 400. A memory update operation will now be described in detail with reference to FIGS. 3 and 4.

The n-bit counter 221 counts the number of rising edges or the number of pulses by being clocked at or synchronized with the rising edges of the vertical synchronous signal VSYNCH, and generates an n-bit count signal CNT[i]. The n-bit counter 221 is reset in response to a reset signal RESET generated by the graphics processor 240.

When the n-bit counter 221 is a first-bit counter, the first-bit counter 221 transmits a one-bitcount signal CNT[1] to the determination circuit 223, where a 'high' may be represented by a one or a 'low' may be represented by a zero.

The determination circuit 223 receives the one-bit count signal CNT[1] from the first-bit counter 221, compares the one-bit count signal CNT[1] with a predetermined first-bit reference signal, and outputs the result. For example, when the predetermined one-bit reference signal is one, and the one-bit count signal CNT[1] is one, the result of comparison of the two is one.

The first NAND gate 225 receives and NANDs the output from the determination circuit 223 and the data enable signal DE, and generates a first internal data enable signal IDE_J (j=1).

Therefore, the first internal data enable signal IDE_1 generated by the first NAND gate 225 is activated every second pulse of the vertical synchronous signal VSYNCH. In other words, the first internal data enable signal IDE_1 is activated when an output signal of the first-bit counter 221 is one, that is, the one-bit count signal CNT[1].

The period of the first internal data enable signal IDE_1 is longer than that of the data enable signal DE. The period of the first internal data enable signal IDE_1 may be an integral multiple of the period of the data enable signal DE.

The second NAND gate 227 receives and NANDs the first internal data enable signal IDE_1 output from the first NAND 225 and the clock signal CLK, and generates a data write enable signal WR_EN. Therefore, where the first internal data enable signal IDE_1 is activated, the data write enable signal WR_EN is the same as the clock signal CLK.

The third NAND gate 229 stabilizes the display data DDATA. The third NAND gate 229 receives and NANDs the first internal data enable signal IDE_1 output from the first NAND gate 225 and the display data DDATA, and transmits first display data DDATA_1 to the memory device 222.

The memory device 222 receives the first display data DDATA_k (k=1) output from the third NAND gate 229 and stores the first display data DDATA_1 in response to the data write enable signal WR_EN.

The memory device 222 updates the first display data DDATA_1 only when the first internal data enable signal IDE_1 is activated. Then, the memory device 222 transmits the updated first display data DDATA_1 to the data line driving circuit 150 in response to the control signals generated by the graphics processor 240.

Here, D00 through D05 indicate the updated first display data DDATA_1. B11 through B15 indicate when memory updating is not performed even though the data enable signal DE is activated.

In this regard, the LCD driver 210 including the timing controller 220 consumes less current than the conventional LCD driver 100 that consumes current for memory updating at all times when the data enable signal DE is activated.

Similarly, when the n-bit counter 221 is as a second-bit counter, the second-bit counter 221 transmits a two-bit count signal CNT[2] to the determination circuit 223.

The determination circuit 223 receives the two-bit count signal CNT[2] from the second-bit counter 221, compares the two-bit count signal CNT[2] with a predetermined two-bit reference signal, and outputs the result of the comparison. For example, when the predetermined two-bit reference signal is 11, and the two-bit count signal CNT[2] is 11, the result of the comparison is one.

The first NAND gate 225 receives and NANDs the output signal of the determination circuit 223 and the data enable signal DE, and generates a second internal data enable signal IDE_j (where j=2). The period of the second internal data enable signal IDE_2 is longer than the period of the data enable signal DE. Therefore, the second internal data enable signal IDE_2 generated by the first NAND gate 225 can be activated every fourth pulse of the vertical synchronous signal VSYNCH. In other words, the second internal data enable signal IDE_2 generated by the first NAND gate 225 is activated when the second-bit count signal CNT[2] output from the second-bit counter 221 is 11. Here, the period of the second internal data enable signal IDE_2 is four times longer than that of the data enable signal DE.

The second NAND gate 227 receives and NANDs the second internal data enable signal IDE_2 generated by the first NAND 225 and the clock signal CLK, and generates the data write enable signal WR_EN. The third NAND gate 229 receives and NANDs the second internal data enable signal IDE_2 generated by the first NAND 225 and the display data DDATA, and transmits second display data DDATA_k (where k=2) to the memory device 222.

The memory device 222 receives the second display data DDATA_2 from the third NAND gate 229 and stores the second display data DDATA_2 in response to the data write enable signal WR_EN. The memory update operation is performed in the memory device 222 when the second internal data enable signal IDE_2 is activated. The memory device 222 transmits the updated second display data DDATA_2 to the data line driving circuit 150 in response to the control signals generated by the graphics processor 240.

With reference to FIG. 4, D10 through D13 indicate the updated second display data DDATA_2. B21 through B23 indicate when memory updating is not performed even though the data enable signal DE is activated.

In this regard, the LCD driver 210 of FIGS. 2 and 3, which performs a memory update operation only when the second internal data enable signal IDE_2 is activated, consumes less current than the conventional LCD driver 120 of FIG. 1, which performs a memory update operation at all times when the data enable signal DE is activated.

As described above, a timing controller, an LCD driver including the same, and a method of outputting display data according to embodiments of the present disclosure significantly reduce memory update operating current while using a video interface.

While the present invention has been particularly shown and described with reference to exemplary embodiments thereof, it will be understood by those of ordinary skill in the pertinent art that various changes in form and details may be made therein without departing from the spirit and scope of the present invention as defined by the following claims.

What is claimed is:

1. A timing controller of a liquid crystal display driver for controlling the timing of each of a scan line driving circuit and a data line driving circuit, the timing controller comprising:

an n-bit counter counting a number of pulses of a vertical synchronous signal clocked at the vertical synchronous signal and generating an n-bit count signal;

a determination circuit for receiving the n-bit count signal, comparing the n-bit count signal with a predetermined n-bit reference signal, and outputting the result of comparison;

a first NAND gate NANDing a signal output from the determination circuit and a data enable signal;

a second NAND gate NANDing a signal output from the first NAND gate and a clock signal; and a memory device receiving and storing first display data in response to the signal output from the second NAND gate, wherein the timing controller controls the timing of each of the data line driving circuit and the scan line driving circuit in response to input display data and control signals including the vertical synchronous signal and the data enable signal and generates an internal data enable signal in response to the control signals, and the memory device receives and stores the input display data in response to the internal data enable signal having a period that is a plural integral multiple of the period of the data enable signal.

2. The timing controller of claim 1, further comprising a third NAND gate for NANDing the signal output from the first NAND gate and second display data and outputting the first display data.

3. The timing controller of claim 2, wherein the timing controller receives the vertical synchronous signal, the data enable signal, the clock signal, and the second display data output from a graphics processor via a video interface.

4. A timing controller of a liquid crystal display driver for controlling the timing of each of a scan line driving circuit and a data line driving circuit, the timing controller comprising:

a counter for counting a number of rising edges of a vertical synchronous signal in synchronization with the vertical synchronous signal and outputting the result;

a determination circuit for receiving a signal output from the counter, comparing the signal with a predetermined reference signal, and outputting the result of comparison;

a first NAND gate for NANDing a signal output from the determination circuit and a data enable signal;

a second NAND gate for NANDing a signal output from the first NAND gate and a clock signal; and a memory device for receiving and storing first display data in response to the signal output from the second NAND gate, wherein the timing controller controls the timing of each of the data line driving circuit and the scan line driving circuit in response to input display data and control signals including the vertical synchronous signal and the data enable signal and generates an internal data enable signal in response to the control signals, and the memory device receives and stores the input display data in response to the internal data enable signal having a period that is a plural integral multiple of the period of the data enable signal.

5. The timing controller of claim 4, further comprising a third NAND gate for NANDing the signal output from the first NAND gate and second display data and outputting the first display data.

6. A liquid crystal display driver for driving a liquid crystal display panel comprising data lines and scan lines, the liquid crystal display driver comprising:

a timing controller comprising a memory device;

a data line driving circuit for driving data lines of the liquid crystal display panel based on display data stored in the memory device; and a scan line driving circuit for sequentially driving the scan lines, wherein the timing controller controls the timing of each of the data line driving circuit and the scan line driving circuit in response to input display data and control signals including a vertical synchronous signal and a data enable signal and generates an internal data enable signal in response to the control signals, and the memory device receives and stores the input display data in response to the internal data enable signal having a period that is a plural integral multiple of the period of the data enable signal.

7. The liquid crystal display driver of claim 6, wherein the memory device receives and stores the input display data only when the internal data enable signal is activated.

8. The liquid crystal display driver of claim 6, wherein the timing controller comprises:

an n-bit counter for counting a number of pulses of the vertical synchronous signal by being clocked at the vertical synchronous signal and generating an n-bit count signal;

a determination circuit for receiving the n-bit count signal, comparing the n-bit count signal with a predetermined n-bit reference signal, and outputting the result of comparison;

a first NAND gate for NANDing a signal output from the determination circuit and the data enable signal;

a second NAND gate for NANDing a signal output from the first NAND gate and the clock signal; and a third NAND gate for NANDing the signal output from the first NAND gate and the input display data, wherein the memory device receives and stores first display data in response to the signal output from the first NAND gate.

9. The liquid crystal display driver of claim 6, wherein the input display data and the control signals output from a graphics processor are input to the timing controller via a video interface.

10. A liquid crystal display driver for driving a liquid crystal display panel comprising data lines and scan lines, the liquid crystal display driver comprising:

a timing controller comprising a memory device;

a data line driving circuit for driving data lines of the liquid crystal display panel based on display data stored in the memory device; and a scan line driving circuit for sequentially driving the scan lines, wherein the timing controller controls the timing of each of the data line driving circuit and the scan line driving circuit in response to input display data and control signals including a vertical synchronous signal and a data enable signal and generates an internal data enable signal having a period that is a plural integral multiple of the period of the data enable signal in response to the control signals, and the memory device receives and stores the input display data in response to the internal data enable signal having a period that is longer than the period of the data enable signal.

11. The liquid crystal display driver of claim 10, wherein the memory device receives and stores the input display data only when the internal data enable signal is activated.

12. A method of outputting display data stored in a memory device to a data line driving circuit driving data lines of a liquid crystal display panel comprising the data lines and scan lines, the method comprising:

generating an internal data enable signal having a period that is a plural integral multiple of one cycle of a data enable signal in response to a vertical synchronous signal and a data enable signal;

receiving and storing display data in response to the internal data enable signal; and transmitting display data stored in the memory device to the data line driving circuit in response to control signals.

13. The method of claim 12, wherein the generating the internal data enable signal comprises:

counting a number of pulses of the vertical synchronous signal and outputting the result;

comparing the result with a reference value and outputting the result of the comparison; and generating the internal data enable signal based on the result of comparison and the data enable signal.

14. The method of claim 12, wherein the receiving and storing the display data comprises:

logically combining the internal data enable signal and the clock signal and generating a data write enable signal;

generating the display data by logically combining the internal data enable signal and input display data; and receiving and storing display data output from the memory device in response to the data write enable signal.

15. A method of outputting display data stored in a memory device to a data line driving circuit driving data lines of a liquid crystal display panel comprising the data lines and scan lines, the method comprising:

generating an internal data enable signal having a period that is a plural integral multiple of the period of a data enable signal in response to a vertical synchronous signal and a data enable signal;

receiving and storing display data in response to the internal data enable signal; and transmitting display data stored in the memory device to the data line driving circuit in response to control signals.

16. A timing controller for controlling liquid crystal display drivers, the timing controller comprising:

counting means for counting pulses of a vertical synchronous signal and generating an n-bit count signal;

determination means in signal communication with the counting means for comparing the n-bit count signal with an n-bit reference signal;

logic means in signal communication with the determination means, responsive to the determination means, a data enable signal, and a clock signal; and memory means in signal communication with the logic means for receiving and storing first display data responsive to the logic means, wherein the liquid crystal display drivers comprise scan line driving means and data line driving means, and the timing controller controls the timing of each of the data line driving means and the scan line driving means in response to input display data and control signals including the vertical synchronous signal and the data enable signal and generates an internal data enable signal in response to the control signals, and the memory means receives and stores the input display data in response to the internal data enable signal having a period that is a plural integral multiple of the period of the data enable signal.

17. A timing controller as defined in claim 16, further comprising output means responsive to the logic means, the memory means and second display data for outputting the first display data.

18. The timing controller of claim 17, disposed in signal communication with graphics processing means, wherein the timing controller receives the vertical synchronous signal, the data enable signal, the clock signal, and the second display data from the graphics processing means.

19. A timing controller as defined in claim 16, further comprising generation means for generating the internal data enable signal having a period that is longer than the period of the data enable signal, wherein the logic means is further responsive to the internal data enable signal.

* * * * *